US005107876A

United States Patent [19]

Ozyjiwsky

[11] Patent Number: 5,107,876

[45] Date of Patent: Apr. 28, 1992

[54] PARTS WASHER

[75] Inventor: Roman S. Ozyjiwsky, Salisbury Heights, Australia

[73] Assignee: Balisbex Pty, Ltd., North Adelaide, Australia

[21] Appl. No.: 555,068

[22] Filed: Jul. 18, 1990

[30] Foreign Application Priority Data

Jul. 19, 1989 [AU] Australia ..... PJ5366

[51] Int. Cl.[5] ..... B08B 3/02

[52] U.S. Cl. ..... 134/111; 134/200

[58] Field of Search ..... 134/104.4, 109, 111, 134/200; 210/167

[56] References Cited

U.S. PATENT DOCUMENTS

| | | | |
|---|---|---|---|
| 2,954,789 | 10/1960 | Mescher et al. | 134/111 X |
| 3,707,404 | 12/1972 | Carlson et al. | 134/109 X |
| 4,226,548 | 10/1980 | Reith | 134/111 X |
| 4,261,768 | 4/1981 | Otzen | 134/56 R |
| 4,433,698 | 2/1984 | Blaul | 134/200 X |
| 4,464,256 | 8/1984 | Plourde | 134/111 X |
| 4,505,284 | 3/1985 | Kyatt | 134/111 X |
| 4,741,351 | 5/1988 | Minken | 134/144 |
| 4,817,649 | 4/1989 | Schmaltz, Jr. | 134/58 R |
| 4,827,955 | 5/1989 | Stern | 134/111 X |

FOREIGN PATENT DOCUMENTS

| | | | |
|---|---|---|---|
| 565596 | 7/1984 | Australia . | |
| 570417 | 1/1988 | Australia . | |
| 105886 | 11/1942 | Sweden | 134/111 X |
| 2203813 | 10/1988 | United Kingdom . | |

*Primary Examiner*—Philip R. Coe

*Attorney, Agent, or Firm*—Michael N. Meller

[57] ABSTRACT

A parts washer wherein storage means below a basin are separated to provide a lowermost sludge collecting part and recirculation of solvent is drawn from only an upper part of the underneath storage means to minimize sludge disturbance. Two separate chambers are disclosed with a conduit from the basin directly feeding draining solvent into a lowermost of the chambers and excess solvent is directed through a second conduit directing solvent through a filter and then into an upper level of the upper chamber. The recirculating pump with its inlet is located in its upper chamber. The lowermost chamber is adapted to be removable for sludge removal and solvent replacement.

9 Claims, 2 Drawing Sheets

PARTS WASHER

Figure 1:
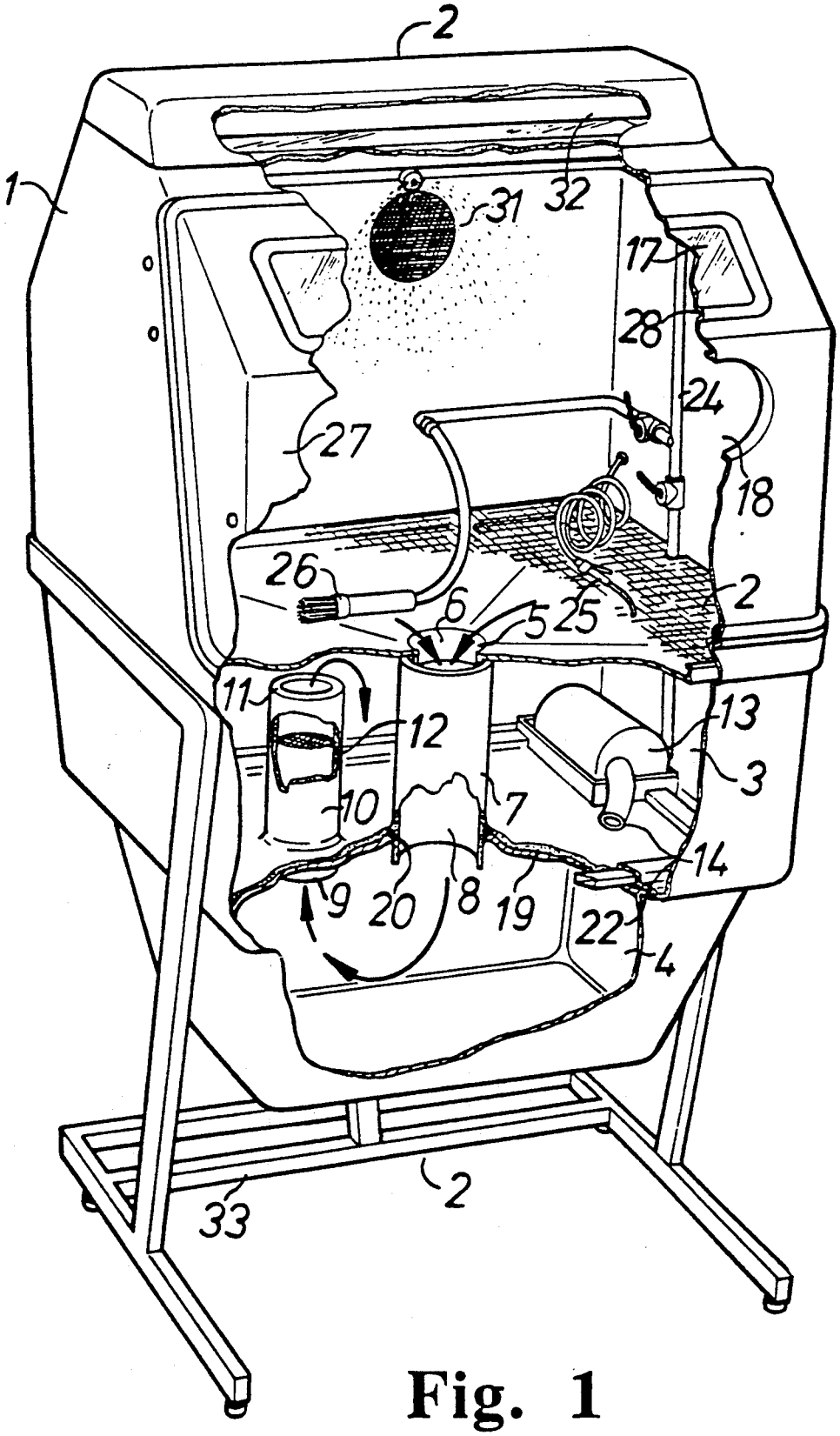

This invention relates to a parts washer.

At the present time it is known to provide a recirculation device so that solvent is pumped through an overhead outlet into a basin in which parts to be cleaned can be located and there is a lowermost outlet within the basin draining into a holding container.

In the presently most commonly used existing device, the holding container is a cylindrical container which is separable from the basin and it is by this means that the solvent is changed from time to time, that is the cylindrical container is physically removed with the solvent in it.

The solvent also is conventionally a selected hydrocarbon solvent and is substantially all hydrocarbon solvent material.

Recirculation of the solvent material is achieved by a pump having an inlet located at about one third the height of the cylindrical container where incidentally the cylindrical shape is located so that the cylindrical axis is substantially vertical, and the returning solvent is direct into the top of the container.

After a significant investigation, it has been discovered that some improvements can be made to this presently existing arrangement which can significantly improve both the period over which solvent can be effectively used, and the operating efficiency of the apparatus during such usage.

It is an object of this invention then to provide an improvement to existing devices.

According to this invention there is proposed a parts washer including an uppermost basin and an underneath storage means, drain means from the basin arranged to direct solvent into the storage means and recirculating pump means adapted to pump solvent from the storage means to an outlet for washing purposes above the basin, the inlet for solvent into the pump means being located at an upper level of the underneath storage means.

A significant problem associated with presently existing type devices is that there is a build up of sludge which becomes increasingly caught up in recirculating material which is eventually the reason why the solvent has to be replaced.

If however, the inlet for the recirculating pump is located at an upper level of the contained fluid, this has a first advantage that it is not located in the vicinity of sludge which has settled or is settling in the bottom of the container and furthermore, by drawing in of solvent merely at an upper location has much less tendency to stir up the settled sludge in the lower part of the storage means.

According to a further preferred feature there is a parts washer as previously described further characterised in that the underneath storage comprises two chambers one located so as to be in substance above the other so that one is an upper chamber and the other is a lower chamber, a conduit adapted to collect solvent from the basic and constrain its passage into the lower chamber and a conduit from the lower chamber located with an inlet within the lower chamber and an outlet in the upper chamber to constrain the passage of solvent passing from the lower chamber directing this into the upper chamber.

In preference, access from the lower chamber to the upper chamber is by way of a conduit which also includes filtration materials so that liquid which is introduced into the lower chamber is caused to rise through the filter material and only after being so filtered will then enter the upper chamber.

In preference, the lower chamber is adapted to be filled either substantially or totally with a separating fluid such as water and additives if necessary and the inlet of the connecting conduit between the lower and upper chambers is located so as to be at an upper most location within the lower chamber.

With such an arrangement, the inlet for the recirculation pump is then located within the upper chamber and such that solvent will be recirculated by being drawn from such upper chamber.

Figure 2:
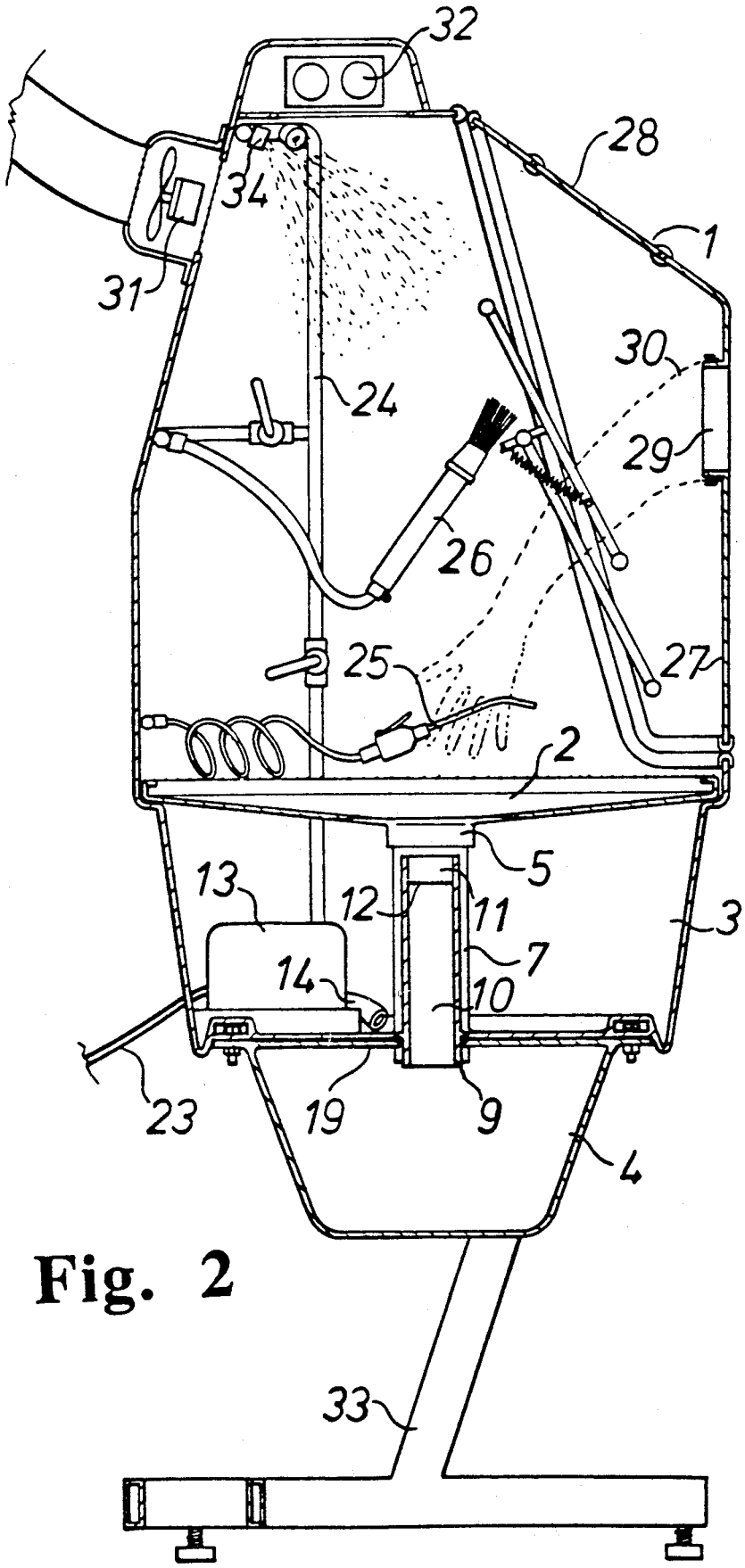

A better understanding of the invention will be achieved by reference to a preferred embodiment which shall be described with the assistance of a drawings wherein:

FIG. 1 shows in part cut away a parts washer according to the preferred embodiment, FIG. 2 is a cross section of the view of 2—2 in FIG. 1.

Referring in detail to the drawings and the embodiment disclosed therein, there is shown as a plastics structure, a parts washer 1 which includes a basin 2 and two collection chambers 3 being an upper chamber and 4 being a lower chamber.

There is a drain in the basin 2 at 5 through which solvent will drain through to the outlet 6 solely into the lower chamber 4.

The conduit 7 is accordingly located to collect the draining solvent from the drain 5 which is provided with a lowermost dish shape and the conduit 7 is adapted to exclusively direct such draining solvents together with detritus into an elevated outlet at 8 within the lower chamber 4.

Removal of material from the lower chamber 4 is achieved in either of two ways but during the operation of the parts washer 1, this is achieved by solvent surging into the elevated inlet 9 of conduit 10 which has an outlet at 11 located in an elevated position within the upper chamber 3.

Furthermore, there is a filter which comprises a mesh filter 12 which is located in line within the conduit 10 so as to provide at least a substantial filtering effect of materials that might otherwise surge into the upper chamber 3 carrying larger particles.

The filter 12 also has the effect of retarding turbulence and thereby also increasing the effect of settlement of sludge within the liquid contained within the lower chamber 4.

Within the upper chamber 3, there is an air operated recirculating pump 13 which has an entry 14 also located within the upper chamber.

Accordingly, the entry to the recirculating pump is in an uppermost part of the underneath storage means which comprises together the upper and lower chambers 3 and 4.

The body 15 which generally comprises the upper chamber 3, and the vapour proof covering 16 together with a viewing window 17 and access apertures 18 is all comprised of a reinforced plastics material firstly to provide for longevity and also to provide for a maintenance free characteristic.

The lower chamber 4 is comprised of reinforced plastics which is formed into an almost completely enclosing chamber shape shown by an upper wall 19 and this is sealably engaging at 20 by 'O' rings the conduit 7.

The lower chamber 4 is intended to be detachably removable so that when sludge is collected therein after a period of use and perhaps is fully filling the chamber, this can be removed by undoing bolts such as shown at 21 and 22 which thereby releases the lower chamber 4 onto an appropriate supporting carriage whereby it is removed for regular removal of the sludge and replacement.

Solvent contained within the upper chamber 3 of course will be kept in the chamber 3 and will not be lost while the removal at the lower chamber 4 occurs.

The recirculating pump 13 is operated by an air supply 23 so that there is not the unnecessary feature of electrical power within the otherwise highly inflammable environment of the solvent containing chambers 3 and 4.

A number of advantageous features of the upper part of the parts washer 1 are also included including a spray distribution conduit 24, a jet spray 25, and a brush spray 26.

It is well known that solvents of the type that are necessary for parts washers can be highly toxic for extended usage to workers and there is therefore provided a liftable door 27 which includes a viewing window 28 and access apertures 29 which can be made totally sealable by attaching as is shown in dotted outline, hand covers 30.

Additional features to the device as shown includes a vented outlet 31 and a totally sealed light 32.

The whole device is supported by an adjustably supported frame 33.

From this description then it will be realised that what can be achieved is that solvent which can comprise any appropriate hydrocarbon solvent or otherwise, can be first located within the upper chamber 3 and caused to recirculate into the jet 25 or the brush 26 or the jet outlets for spraying purposes 34.

Such solvent however collects apart from dissolved materials, separated materials which can comprise variously metal particles, and other materials which can be variously termed sludge.

If this solvent is then left to settle in relatively undisturbed conditions, it will collect at a lowermost position and of course in this position can be separately removed.

To this extent then the concept is to provide that the solvent with the sludge suspended in turbulent solvent is directed into the lowermost chamber but the arrangement is such that there will be relatively negligible disturbance of the liquid including sludge within the lower chamber 4.

Accordingly as the sludge settles, it is only the uppermost levels of the liquid that will surge through the conduit 10 and there is a filter in the conduit to remove gross contamination although to a large extent this may not be necessary in many instances.

By locating the upper end of the conduit 10 at an elevated position within the upper chamber 3, this firstly ensures that it is only excess flow from the solvent surging into the lower chamber 4 that will pass then into the upper chamber 3 and in the event of removal of the lower chamber 4, there will of course be no outlet path for such solvent.

The recirculation pump 13 with especially its inlet 14 is ideally positioned simply to take solvent then introduced into the upper chamber 3 and return this to the various outlets 25, 26 and 34.

From what has now been described, it will be realised that this provides significant improvement to the parts washer concept and it has in practise provided significant reduced running cost for the provision of a parts washer to the various users of these devices.

I claim:

1. A parts washer including a basin adapted to contain parts to be washed and a storage means for storing washing solvent, said storage means comprises two chambers one located above the other so that one is an upper chamber and the other is a lower chamber, a first conduit adapted to collect solvent from said basin and constrain its passage into said lower chamber and a second conduit from said lower chamber located with an inlet within said lower chamber and an outlet in said upper chamber to constrain the passage of solvent passing from said lower chamber directing this into said upper chamber and a recirculating pump means having an inlet within said upper chamber.

2. A parts washer as in claim 1, wherein there are filter means within said second conduit adapted to effect a filtering of solvent passing from said lower chamber to said upper chamber.

3. A parts washer comprising a basin, underneath solvent storage means comprising, an upper and a lower chamber, located directly below said basin, a first conduit located to catch draining solvent from said basin and direct this into said lower chamber, and a second conduit extending between said lower chamber and said upper chamber and adapted to direct solvent from said lower chamber into said upper chamber, filter means to effect a filtering of solvent that may pass through said second conduit, the outlet of said second conduit being at an elevated position within said upper chamber, and the inlet of the said second conduit being at an elevated position within said lower chamber and a recirculating pump means having an inlet within said upper chamber.

4. A parts washer as in claim 3, wherein the lower chamber is detachably supported relative to the upper chamber so as to be removable with sludge collected from cleaning solvent.

5. A parts washer as in claim 4, wherein said lower chamber is comprised of a substantially enclosed chamber.

6. A parts washer as in claim 4, wherein the basin is enclosed by a vapor proof cover including solvent distribution means.

7. A parts washer as in claim 3, wherein the basin is enclosed by a vapor proof cover including solvent distribution means.

8. A parts washer comprising a basin with a vapor proof cover, underneath solvent storage means comprising two chambers one located above the other and being thereby an upper chamber and a lower chamber located directly below the basin, a first conduit located to catch draining solvent from the basin and direct this solely into the lower chamber and having its outlet at an elevated location within the lower chamber, and a second conduit extending between the lower chamber and the upper chamber and adapted to direct solvent from the lower chamber solely into the upper chamber, filter means within said second conduit to effect a filtering of solvent that may pass therethrough, the outlet of said second conduit being at an elevated position within the upper chamber, and the inlet of said second conduit being at an elevated position within the lower chamber and a recirculating pump means having an inlet within said upper chamber.

9. A parts washer including a basin and storage means located beneath said basin, said storage means comprising two chambers one located above the other so that one is an upper chamber and the other is a lower chamber, a first conduit adapted to collect solvent from said basin and constrain its passage into said lower chamber, a second conduit from said lower chamber located with an inlet within said lower chamber and an outlet in said upper chamber to constrain the passage of solvent passing from said lower chamber directing this into said upper chamber, and recirculating pump means adapted to pump solvent from said storage means to an outlet above said basin wherein the recirculating pump means together with its inlet is located within the upper chamber.

* * * * *